US006981342B2

(12) United States Patent
Lopata

(10) Patent No.: US 6,981,342 B2
(45) Date of Patent: Jan. 3, 2006

(54) SCREENING LAYING BOX

(75) Inventor: Michael E. Lopata, Clinton, NY (US)

(73) Assignees: Power Line Constructors, Inc.; PLC Trenching Co., LLC., Clinton, NY (US)

( * ) Notice: Subject to any disclaimer, the term of this patent is extended or adjusted under 35 U.S.C. 154(b) by 154 days.

(21) Appl. No.: 10/722,658

(22) Filed: Nov. 24, 2003

(65) Prior Publication Data

US 2005/0108903 A1 May 26, 2005

(51) Int. Cl.
*E02F 5/22* (2006.01)
*F16L 1/02* (2006.01)
*H02G 9/00* (2006.01)

(52) U.S. Cl. ..... 37/142.5; 405/179; 405/180

(58) Field of Classification Search ..... 405/179, 405/182, 180, 174, 154.1; 37/366, 367, 369, 37/379, 380, 405, 142.5
See application file for complete search history.

(56) References Cited

U.S. PATENT DOCUMENTS 4,812,078 A * 3/1989 Rivard ..... 405/179
5,938,373 A * 8/1999 Scudder ..... 405/179

* cited by examiner

*Primary Examiner*—Christopher J. Novosad
(74) *Attorney, Agent, or Firm*—Darby & Darby

(57) ABSTRACT

A mechanized unit that is moved through a trench in the ground for the purpose of placing a length or lengths of a utility or utilities by a guide device on the bottom of the trench, and then encasing the placed utility or utilities. The unit has at least one plow to sweep the material excavated from the ground to form the trench back into the trench onto a screening member mounted to the unit. The screening unit has spaced screens one above another with progressively smaller openings from top to bottom and the screening member is vibrated to deposit onto the one or more utilities layers of the excavated material having particles of progressively larger size from the bottom to the top of the trench to protect the utility or utilities from physical damage caused by larger excavated particles.

16 Claims, 3 Drawing Sheets

SCREENING LAYING BOX

BACKGROUND OF THE INVENTION

Mechanized units are known that are moved through a trench in the ground for the purpose of laying a continuous length or connected lengths of a utility or utilities, such as conduits, pipes, cables, etc. or combinations thereof. The mechanized unit is primarily intended to place in the trench flexible utilities such as electrical and communication and data cables or rigid pipes for water, sewer, and/or gas, or any combination thereof, and then encase the one or more utilities with protective material The mechanized unit may be propelled through the trench by being connected directly to the device that excavates the trench or by any other mechanical moving device, such as a tractor or other vehicle.

In one type of application, the flexible utility or utilities pass down through the unit onto the bottom of the trench by means of a guide device that maintains a desired spatial relationship between utilities in applications in which more than one utility is laid in the trench. As the utility or utilities pass through and/or exit the guide device, protective material, which has been deposited in the upper portion of the mechanized unit, gravitates in a generally vertical direction through the mechanized unit, onto and around the utility or utilities being installed. This type of installation has a disadvantage in that the material to be used for the encasement must be specially obtained, usually by purchasing, from a suitable processing facility, such as a gravel/sand pit or stone quarry. Alternatively, the encasement material must be processed on site using portable screening equipment. The purchasing, hauling and handling or processing and handling of this protective material can add considerable time and costs to the installation.

Accordingly, it is desirable to provide a mechanized unit that overcomes the forgoing disadvantages in an application that uses excavated trench material and that can protect the utility or utilities in a trench in a manner that is efficient and cost effective.

BRIEF DESCRIPTION OF THE INVENTION

In accordance with the invention a mechanized unit is provided that places a continuous length or connected lengths of a utility or utilities at a predetermined spatial relationship with each other near the bottom of an excavated trench. As the mechanized unit moves along the trench, it sweeps the excavated material that has been placed along the one or both sides of the trench back into the trench onto a screening member. The screening member is constructed so that layers of the excavated material of increasing particle size are deposited over the utility or utilities. The layer of smallest particles directly encase the utility or utilities rather than larger size particles. This protects the utility or utilities from stresses or direct physical damage that would be caused by large excavated soil or rock particles. The mechanized unit of the invention accomplishes this in one continuous operation together with the laying of the one or more utilities.

In the invention the mechanized unit is provided with vertical side walls that hold back the sides of the trench. This prevents collapse of the trench walls and also prevents any material from falling into the trench which could damage the utility or utilities being installed prior to their encasement by the protective screened material.

BRIEF DESCRIPTION OF THE DRAWINGS

Other objects and advantages of this invention will become more apparent by referring to the following description of operation and referring to the accompanying drawings, in which.

DETAILED DESCRIPTION OF THE INVENTION

Figure 1:
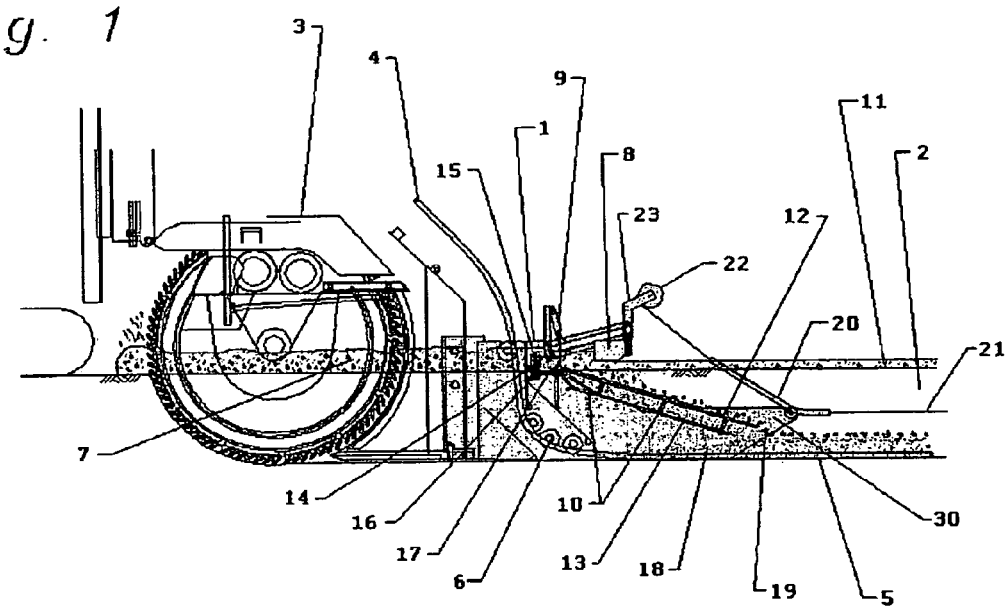
FIG. 1 is a side elevational view in cross-section of the mechanized unit.

Referring to the drawings, the mechanized unit 1 of the invention is pulled (from right to left as shown in FIG. 1) through a trench 2 by a conventional trencher unit 3, illustratively of the wheel type, which excavates the trench. Such trencher units 3 can dig a trench of predetermined depth and width as it moves along the ground. Any other suitable mechanism can be used to excavate the trench and the trench also can be hand dug. As the trencher 3 moves it deposits the material 7 that has been excavated along one or both sides of the top 11 of the trench 2.

The mechanized unit 1 has a frame to which is mounted a pair of vertical side walls 30 formed by metal plates that are spaced apart by a distance generally corresponding to the space between the trench walls. As the mechanized unit 1 moves forward, the utility or utilities 4 being installed pass down from a supply source (not shown) through the mechanized unit 1 and into the trench 2. The supply source for the one or more utilities 4 can be, for example, one or more reels of cable that are carried by the unit 1 or by a vehicle moving in parallel with unit 1 along the trench 2, or pieces of pipe that are laid down and are joined together. The one or more utilities 4 are positioned near the bottom of the trench 2, by means of a guide device 6 which can be formed of a plurality of rollers or chutes, as appropriate. If more than one utility is being laid in the trench, the guide device 6 is preferably configured to maintain a desired spatial relationship between the one or more utilities. The unit side walls 30 prevent the trench from collapsing and protect the utility or utilities as they are laid in the trench.

Figure 2:
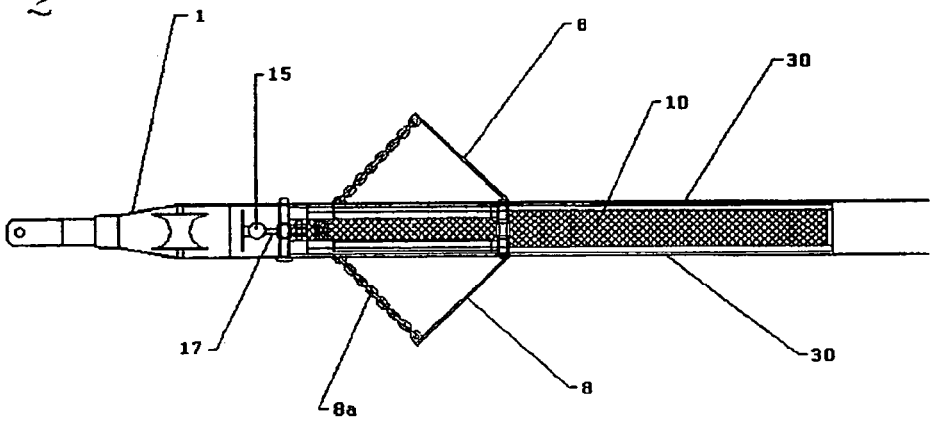
FIG. 2 is a top view.

A plow 8 is mounted to each side of the frame of the mechanized unit 1 at an angle, for example, about 45°. The plows 8 are above the trench top 11 and contact the excavated material 7 deposited along the one or both sides of the top 11 of trench 2. As the mechanized unit is moved forward, the plows 8 sweep the material 7 back into the trench 2 onto the top of a screening member 10, described below, mounted to the frame of the mechanized unit 1. As shown in FIG. 2, the ends of the plows 8 are stabilized by chains 8*a* or rigid struts connected to the frame of the unit. The height of plows 8 is raised and lowered, preferably by a hydraulic device 9, or by any other mechanical means, for example a threaded screw arrangement, so that the appropriate amount of excavated material 7 is plowed back into the trench 2.

Figure 3:
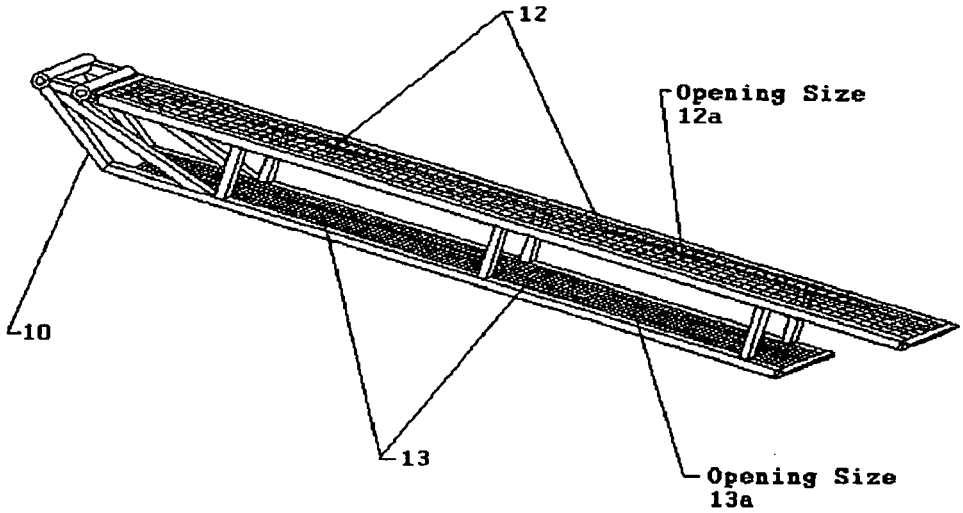
FIG. 3 is a orthographical view of the screening member.

The screening member 10 is fixedly connected to the frame of mechanized unit 1 and extends below the top 11 of the trench 2. The screening member 10 fits between the mechanized unit side walls 30 and slopes in a downward direction towards the rear of the unit 1. The screening member 10 has at least one screen and preferably a number of layers of screens that lie above one another and are spaced apart vertically. In the embodiment of the invention being described, and referring to FIG. 3, two screens 12 and 13 are illustratively shown for the screening member 10. The two screens 12 and 13 are fixedly mounted to the frame of screening member 10 which is mounted to the framework of unit 1. The upper screen 12 has openings 12*a* that are larger than the openings 13*a* of the lower screen 13. The trailing, or rear, end of the upper screen 12 extends further out from the frame of screening member 10 than the trailing edge of the lower screen 13. This also can be seen in FIG. 1.

In general, any number of screens can be used for the screening member 10. There can by only one screen. Where multiple screens are used, the screens would have progressively smaller openings (mesh size) from the top to bottom of the screening member. Also, the trailing end of each screen would progressively extend further out in the direction rearwardly of the mechanized unit from the bottom to top of the screening member. That is, the length of each screen becomes progressively shorter from the top to bottom of the screening member. The screens of unit 10 can be of any suitable material, metal being preferred for durability. Also, the size of the screen mesh openings is selected in accordance with the size of material 18 required to protect the utility or utilities and the properties of the material excavated from the trench that is being moved back into the trench.

A shaker 14 formed by a hydraulic motor 15 or any other mechanical means is mounted to the unit 1 framework. The motor 15 turns a crankshaft 16 that is connected to the screening member 10 frame by a connecting rod 17. The shaker 14 is operated at a desired rate and preferably has a movement that moves the screening member 10 by a desired distance forward and back and up-and-down. Any suitable type of shaking or vibrating device can be utilized. In addition, although more complex, the screens of the screening member 10 can be moved individually with respect to each other.

The shaking action accomplished by the shaker 14 facilitates the passage of the excavated material through each successive screen of the screening member. In the multi-screen embodiment illustrated, the portion of the excavated material 7 that has been plowed from the top of the trench onto the screening member 10 and that has a size smaller than the openings 12*a* of the top screen 12 will pass through the top screen 12 and gravitate to the next lower screen 13 with smaller openings 13*a*. The particles having a larger size than the openings 12*a* of the upper screen 12 slide off of the downwardly sloping top surface of screen 12 and back into the trench. Similarly, the particles that pass through openings 12*a* of the upper screen 12 onto the top surface of the lower screen 13 but are too large to pass through the lower screen openings 13*a* slide off the top surface of the lower screen 13 back into the trench. The particles that pass through the lower screen smaller openings 13*a* fall directly down into the trench encasing the utility or utilities.

As the excavated material passes vertically through the successive screens 12 and 13 it is separated by particle size. The smallest size particles 18 pass through the lowest screen 13 to directly contact and cover the utility or utilities 4 that have been placed near the bottom of the trench 2. If the one or more utilities are slightly raised from the trench floor, the smaller size particles will flow below them and form a bed. The particles that slide off of the upper screen 12 form the top layer of the encasement.

As the mechanized unit 1 moves forward, three layers of encasing material of progressively larger particle size are laid over the one or more utilities 4. The first layer is the smallest particle size material 18 that passes through the openings of the lower screen 13. The second layer is the particles of material that have passed through the larger openings 12*a* of the upper screen 12 but are too large to pass through the openings 13*a* of the lower screen layer 13. The third layer is the larger particles 19 that have not passed through the openings 12*a* of the upper screen 12. These large particles 19 gravitate down along the upper surface of the upper screen 12 and are shaken down and to the rear of that screen until they fall off of the back end of that screen 12 and gravitate onto the layers of material, including the one formed of the smaller particles 18, that cover and protect the utility or utilities. Even though the size of the particles 19 falling off the upper surface of the top screen 12 may be relatively large, they do not damage the one or more utilities laid in the trench since these are already covered by two layers of material of smaller particle size. Also, the force of the large particles 19 sliding off the top of the upper screen 12 is relatively small as compared to a direct vertical drop of such large size particles. Accordingly, as seen, the screening member 10 functions to cover the utility or utilities with layers of protective materials of successively increasing particle size.

Where the screening member 10 has only one screen, two layers of particles will be provided. The first is formed by the particles passing through the screen opening and the second by the larger size particles that slide off of the screen.

A guide device 20 is attached at the rear of the mechanized unit 1 to place a warning ribbon 21 in the trench above the installed utility or utilities. The roll of warning ribbon 22 is supported by a warning ribbon roll support 23 attached to the unit 1 framework.

Specific features of the invention are shown in one or more of the drawings for convenience only, as each feature may be combined with other features in accordance with the invention. Alternative embodiments will be recognized by those skilled in the art and are intended to be included within the scope of the claims.

What is claimed is:

1. A movable unit for screening excavated material to protectively cover or encase one or more utilities in an excavated trench, comprising:

a screening member mounted to the unit and located within the trench above the one or more utilities in the trench;

a plow for sweeping excavated material lying along at least one side of the trench onto said screening member, wherein said screening member has at least one screen with a plurality of openings with the excavated material passing through the openings of said at least one screen to deposit onto the utility or utilities installed in the trench as the unit moves.

2. A movable unit as claimed in claim 1, and further comprising a guide for placing a length of at least one utility onto which the screened material is deposited in the trench as the unit moves.

3. The movable unit as claimed in claim 1 wherein said screening member is mounted to said movable unit with a downward slope in the trench away from the direction of movement of the movable unit.

4. The movable unit as claimed in claim 1 and further comprising a shaker unit connected to said screening member to shake said screening member to facilitate passage of particles though the openings of said at least one screen.

5. The movable unit as claimed in claim 1 wherein said screening member comprises a first screen as an upper screen and a second screen as a lower screen, the trailing end of said first screen extending further in a rearward direction of the unit than the trailing end of said second screen, said second screen having openings of a smaller size than the openings of said first screen, whereby a first layer of smallest size particles passing through the openings of said first and second screens are deposited on at least one utility in the trench, a second layer of particles of a size smaller than the openings of said first screen but larger than the openings of said second screen that slides off of the top surface of said second screen onto the first layer of particles, and a third layer of particles of a size larger than the openings of said first screen that slide off of the top surface of said first screen onto the second layer of particles.

6. The movable unit as claimed in claim 5 and further comprising a vertical plate mounted on each side of said movable unit to support a wall of the trench and to prevent material from falling onto at least one installed utility being covered by the layers of the particles.

7. The movable unit as claimed in claim 1 and further comprising a vertical plate mounted on each side of said movable unit to support a wall of the trench to prevent material from falling onto at least one installed utility being covered by the layers of the particles.

8. The movable unit as claimed in claim 1, and further comprising a means for adjusting the height of said plow relative to the top of the trench.

9. The movable unit as claimed in claim 1 wherein said screening member is formed in a manner to deposit in the trench layers of the material having progressively larger particle sizes from the bottom to the top of the trench.

10. The movable unit as claimed in claim 9 wherein said screening member comprises a plurality of screens spaced apart, one above the other, with said screens having progressively smaller openings from the top to bottom of the screening member.

11. The movable unit as claimed in claim 10 wherein said screening member is mounted to said movable unit with a downward slope in the trench away from the direction of movement of the movable unit.

12. The movable unit as claimed in claim 11 wherein the trailing end of each screen of said screening member extends out further in a direction rearward of the movable unit movement than the screen immediately below it.

13. The movable unit as claimed in claim 12 and further comprising a shaker unit connected to said screening member to shake said screening member to facilitate passage of particles though the openings of each of said plurality of screens.

14. The movable unit as claimed in claim 9 wherein said screening member is mounted to said movable unit with a downward slope in the trench away from the direction of movement of the movable unit.

15. The movable unit as claimed in claim 14, and further comprising a shaker unit connected to said screening member to shake said screening member to facilitate passage of particles though the openings of said first and second screens.

16. The movable unit as claimed in claim 14 wherein said screening member comprises said first screen as an upper screen and a second screen as a lower screen, the trailing end of said first screen extending further in a rearward direction of the unit than the trailing end of said second screen, said second screen having openings of a smaller size than the openings of said first screen, whereby a first layer of smallest size particles passing through the openings of said first and second screens are deposited on the at least one utility in the trench, a second layer of particles of a size smaller than the openings of said first screen but larger than the openings of said second screen that slides off of the top surface of said second screen onto the first layer of particles, and a third layer of particles of a size larger than the openings of said first screen that slide off of the top surface of said first screen onto the second layer of particles.

* * * * *